United States Patent [19]

Johnson

[11] 4,162,983

[45] Jul. 31, 1979

[54] FABRIC CARE COMPOSITION CONTAINING STARCH AND SURFACTANT

[75] Inventor: Samuel M. Johnson, Cincinnati, Ohio

[73] Assignee: The Procter & Gamble Company, Cincinnati, Ohio

[21] Appl. No.: 885,925

[22] Filed: Mar. 13, 1978

[51] Int. Cl.[2] ..... D06M 13/00

[52] U.S. Cl. ..... 252/8.6; 8/115.6; 106/213

[58] Field of Search ..... 252/8.6; 8/115.6; 106/213

[56] References Cited

U.S. PATENT DOCUMENTS

| | | | |
|---|---|---|---|
| 2,702,755 | 2/1955 | Chaney | 106/213 |
| 3,892,681 | 7/1975 | Edwards | 252/8.6 |

*Primary Examiner*—William E. Schulz
*Attorney, Agent, or Firm*—Edmund F. Gebhardt; Thomas H. O'Flaherty; Richard C. Witte

[57] ABSTRACT

Compositions and process for preparing stable aqueous liquid suspensions containing specific stabilized gelatinized vegetable starch and surface-active detergents. The compositions herein can be employed as fabric care agents, particularly following exposure of fabrics to washing media containing water-insoluble solvents.

11 Claims, No Drawings

FABRIC CARE COMPOSITION CONTAINING STARCH AND SURFACTANT

BACKGROUND OF THE INVENTION

This invention relates to compositions and processes for preparing liquid suspensions containing specific stabilized gelatinized vegetable starch and surface-active agents. The compositions of this invention can be used for simultaneously providing fabric care benefits and a solvent removal action for fabrics exposed to washing media containing water-insoluble solvents.

The copending commonly assigned patent application of Rodney M. Wise and Sharon J. Mitchell entitled DETERGENT COMPOSITIONS FOR EFFECTIVE OILY SOIL REMOVAL (U.S. Ser. No. 839,221, filed Oct. 3, 1977) discloses compositions and methods for removing oily soils from fabrics involving treatment with specific mixtures of solvents and solvent soluble emulsifiers in aqueous washing media followed by treatment with surface-active agents to remove retained solvent and emulsifier from the fabrics.

The present invention provides fabric care compositions comprising a specific stabilized gelatinized vegetable starch and a surface-active detergent. The compositions are useful in fabric care applications requiring a combination of a sizing effect and detergency. As hereinafter described, aqueous liquid gelatinized starch dispersions are stabilized by exposure to a pH in the range of from about 10 to about 13 or gelatinized and stabilized simultaneously by heating to above the starch's gelatinization temperature while exposing the starch to the required pH. Any excess alkali is then neutralized to a pH of from about 4 to about 9. The compositions contain from about 5% to about 50% of a surface-active detergent selected from the group consisting of anionic, nonionic, zwitterionic and amphoteric surface-active detergents and mixtures thereof and have a pH of from about 4 to about 11.

STATE OF THE ART

Stabilization of liquid starch dispersions and suspensions to prevent retrogradation of gelatinized starch is known. Retrogradation is a phenomena attributed to molecular reassociation of starch to polymeric forms previously broken down by heat or treatment by acids, enzymes or oxidization.

U.S. Pat. No. 2,014,794, (Bierly) discloses inhibition of the congealing of starch solutions by addition of low levels of fatty alcohol sulfates.

U.S. Pat. No. 2,702,755, (Chaney) discloses the preparation of stable cornstarch dispersions in water by adding NaOH to provide a pH of 10 to 12 and cooking such dispersions with agitation at 140° F. to 160° F. for 5 to 30 minutes followed by cooking and neutralization to pH 5.5 to 7. There is no disclosure of the incorporation of surface-active agents or that the process provides for stable combinations of starch and surface-active detergents.

U.S. Pat. No. 3,130,081, (Evans) discloses preparation of amylose dispersions in a pH range at which amylose is normally insoluble. The process involves addition of 4% to 10% of a strong alkali to 5% to 20% dispersions of amylose in water at a temperature of 90° F. to 180° F. followed by neutralization to a pH of 2 to 9. The process is said to be applicable to starch products containing at least 50% amylose as contrasted with natural vegetable starches that generally contain no more than about 30% amylose.

While the stabilization of vegetable starch and amylose by treatment with alkaline materials is known, it has not been recognized that such treatment provides a particular benefit to combinations of starch and surface-active detergents in aqueous media.

It is an object of the present invention to provide compositions and processes for stable suspensions containing gelatinized vegetable starch and surface-active detergents.

A further object of this invention is to provide fabric care compositions adapted for use on fabrics previously exposed to washing media containing water-insoluble solvents.

These and other objects are obtained herein, as will be seen by the following disclosure.

SUMMARY OF THE INVENTION

The present invention encompasses liquid fabric care composition suitable for restoring body to fabrics comprising:

(a) from about 1% to about 25% of a gelatinized and stabilized vegetable starch prepared by exposing a water dispersion of a gelatinized vegetable starch to a pH of from about 10 to about 13 to stabilize said starch and thereafter neutralizing any excess alkali to provide a pH of from about 4 to about 9;

(b) from about 5% to about 50% of a surface-active detergent selected from the group consisting of anionic, nonionic, zwitterionic and amphoteric surface-active detergents and mixtures thereof;

(c) up to about 20% of an electrolyte; and (d) from about 25% to about 94% water, said composition having a pH of from about 4 to about 11.

Vegetable starches suitable for use in the practice of this invention include corn starch, wheat starch, rice starch and potato starch. Corn starch is particularly suitable.

Alkaline materials suitable for providing a pH of from about 10 to about 13, in the process of this invention include alkali metal hydroxides, carbonates, silicates and phosphates. Alkali metal hydroxides are a convenient source of alkalinity for stabilization.

Surface-active agents suitable for use in the practice in this invention are water-soluble anionic, nonionic, zwitterionic and amphoteric surface-active agents.

DETAILED DESCRIPTION OF THE INVENTION

The fabric care compositions of this invention comprise three essential ingredients:

(1) the specific stabilized gelatinized vegetable starch disclosed herein;

(2) a surface-active detergent; and (3) water

THE STARCH

Starch derived from plant sources is generally a mixture of 15% to 40% linear chain amylose and 60% to 85% branched chain amylopectin. In raw form, plant derived starch is in minute water-insoluble granules that range in size from about 4 to 8 microns for rice to 15 to 100 microns for potato. Corn starch granules are generally in a 10 to 25 micron range. When water suspensions of vegetable starch granules are heated to progressively higher temperatures, nothing substantial occurs until a critical gelatinization temperature is reached, specific to the species of starch. At this temperature the granules swell, lose polarization crosses, and irreversibly lose anisotropy. Potato starch gelatinizes in the range of 56°–67° C., corn starch in the range of 62°–72° C., and rice and sorghum in the range of 68°–78° C. After initial gelatinization, the starch granules continue to swell and the granules' structure is at least partially disrupted to produce the thick-bodied consistency of a cooked starch paste.

Gelatinized starch dispersions are subject to stability problems of which retrogradation is particularly serious. In relatively concentrated dispersions, retrogradation results in a viscosity increase or gelling. In relatively dilute dispersions retrogradation can result in sedimentation. Retrogradation is attributed to molecular reassociation of amylose but dispersion viscosity is also a function of the extent of fragmentation of the swollen starch granules. Gelatinized but intact starch granules substantially contribute to dispersion viscosity.

The starch is preferably used at a level of from about 2.5% to about 10%, most preferably from about 3% to about 7%, by weight of the compositions.

The vegetable starches used in this invention include the so-called modified starches exemplified by starches treated with acid, enzymes or by oxidation or by addition of ether or ester groups. Modified starches generally provide relatively lower viscosity dispersions and are known as "thin boiling" starches. Pre-gelatinized modified starches can also be utilized, in which event no additional heating step is necessary.

Although treatment of starch with alkaline materials is known, it has not previously been recognized that the resultant dispersion is particularly stable in the presence of relatively large amounts of surface-active detergents and optional electrolytes in aqueous compositions.

The process of this invention provides for stabilization of aqueous starch dispersions by exposing an aqueous dispersion of a gelatinized starch to a pH of from about 10 to about 13, preferably from about 10 to about 11, and thereafter neutralizing any excess caustic to a pH of from about 4 to about 9. If the starch has not previously been gelatinized, the starch should be held at a temperature above its gelatinization point for at least about 5 minutes prior to, or simultaneously with the exposure to said pH.

While not wishing to be bound by theory, it appears that alkalinity increases the swelling power of the starch at temperatures above the gelatinization point and that this results in an increase in granule breakdown with a resultant decrease in viscosity. The general mechanism of improved phase stability of alkaline treated gelatinized starch in the presence of surface active agents is believed to involve a reduction of the molecular weight of the amylose fraction and an improved resistance of the amylose to retrogradation, i.e., repolymerization.

SURFACE ACTIVE AGENT

The surface-active detergents of this invention are selected from the group consisting of anionic, nonionic, zwitterionic and amphoteric surface-active detergents and mixtures thereof.

Water soluble anionic surfactants suitable for use in the practice of this invention include the alkali metal, alkaline earth metal, ammonium, and substituted ammonium salts of organic sulfuric reaction products. Examples of salts of organic sulfuric reaction products are sodium alkyl sulfate and sodium alkyl benzene sulfonate wherein the alkyl group contains from about 10 to about 20 carbon atoms. Other preferred surfactants of this class are paraffin sulfonates and olefin sulfonates in which the alkyl or alkenyl group contains from about 10 to about 20 carbon atoms.

Other preferred water soluble anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having about 10 to about 20 carbon atoms. Preferably, R has 12 to 18 carbon atoms. The alcohols can be derived from natural fats, e.g., coconut oil or tallow, or can be synthetic. Such alcohols are reacted with 1 to 30, and especially 3, molar proportions of ethylene oxide and the resulting mixture of molecular species is sulfated and neutralized.

Specific examples of alkyl ether sulfates of the present invention are sodium coconut alkyl triethylene glycol ether sulfate, lithium tallow alkyl triethylene glycol ether sulfate, and sodium tallow alkyl hexaoxyethylene sulfate. Preferred alkyl ether sulfates are those comprising a mixture of individual compounds, said mixture having an average alkyl chain length of from about 12 to 16 carbon atoms and an average degree of ethoxylation of from about 1 to 4 moles of ethylene oxide.

Additional examples of anionic surfactants useful herein are the compounds which contain two anionic functional groups. These are referred to as di-anionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

Water soluble nonionic surfactants having an HLB value of from about 11 to about 18 and useful herein include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 3 to 25 moles of ethylene oxide per mole of alkyl phenol. The alkyl substituent in such compounds may be derived, for example, from polymerized propylene or isobutylene, octene or nonene. Examples of compounds of this type include nonyl phenol condensed with about 9.5 moles of ethylene oxide per mole of nonyl phenol and dodecyl phenol condensed with about 12 moles of ethylene oxide per mole of dodecyl phenol. Commercially available nonionic surfactants of this type include Igepal CO-610 marketed by the GAF Corporation, and Triton X-45, X-114, X-100 and X-102, all marketed by the Rohm and Haas Company.

2. The condensation products of aliphatic alcohols with ethylene oxide. The alkyl chain of the aliphatic alcohol may either be straight or branched and generally contains from about 8 to about 22 carbon atoms. The degree of ethoxylation can vary from about 3 to about 30. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company.

3. The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of at least about 30%, and usually less than about 90%, by weight of polyoxyethylene moieties to this hydrophobic portion provides water-solubility to the molecule. Examples of compounds of this type include certain of the commercially available Pluronic surfactants marketed by the Wyandotte Chemicals Corporation.

4. The condensation products of ethylene oxide with the product resulting from the reaction of propylene oxide and ethylenediamine. The hydrophobic base of these products consists of the reaction product of ethylenediamine and excess propylene oxide, said base having a molecular weight of from about 2500 to about 3000. This base is condensed with ethylene oxide to the extent that the condensation product contains from about 40 to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

5. Surfactants having the formula $R^1R^2R^3N\rightarrow O$ (amine oxide surfactants) wherein $R^1$ is an alkyl group containing from about 10 to about 18 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ is selected from the group consisting of alkyl groups and hydroxyalkyl groups containing from 1 to about 3 carbon atoms. Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds.

Amphoteric synthetic detergents can be broadly described as derivatives of aliphatic, or alkyl substituted hetero cyclic, secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate, sulfate. Examples of compounds falling within this definition are sodium 3-(dodecylamino)propionate, sodium 2-(dodecylamino)ethyl sulfate, sodium 2-(dimethylamino)octadecanoate, disodium 3-(N-carboxymethyldodecylamino)propane-1-sulfonate, disodium octadecyl-iminodiacetate, sodium 1-carboxymethyl-2-undecylimidazole, and sodium N,N-bis(2-hydroxyethyl)-2-sulfato-3-dodecoxy-propylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent attached to an "onium" atom and containing an anionic water-solubilizing group, e.g., carboxy, sulfonate, sulfate, phosphate, or phosphonate. Examples of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; N,N-dimethyl-N-dodecylammonio acetate; 3-(N,N-dimethyl-N-dodecylammonio)propionate; 2-(N,N-dimethyl-N-octadecylammonio)ethyl sulfate; 3-(P,P-dimethyl-P-dodecylphosphonio)propane-1-sulfonate; 2-(S-methyl-S-tert-hexadecylsulfo)ethane-1-sulfonate; 3-(S-methyl-S-dodecylsulfonio)propionate; N,N-bis(oleylamidopropyl-N-methyl-N-carboxymethylammonium betaine; N,N-bis(stearamidopropyl)-N-methyl-N-carboxymethylammonium betaine; N-(stearamidopropyl)-N-dimethyl-N-carboxymethylammonium betaine; 3-(N-4-n-dodecylbenzyl-N,N-dimethylammonio)propane-1-sulfonate; and 3-(N-dodecylphenyl-N,N-dimethylammonio)-propane-1-sulfonate.

The surface-active agent is present in the fabric care composition at a concentration of from about 5% to about 50%, preferably from about 10% to about 30%, and most preferably from about 15% to about 25%.

ELECTROLYTE

Preferably, at least about 0.5%, but not more than about 20% of an electrolyte should be present in the fabric care composition for optimum stability. This can be any suitable inorganic or organic ionizable compound such as the salts or acids—e.g., alkali metal or alkaline earth metal chlorides, sulfates, carbonates, silicates, phosphates, acetates and citrates. Preferably the electrolyte concentration is from about 1% to about 10%, and most preferably from about 2% to about 7%. sodium and potassium carbonate are particularly preferred electrolytes.

WATER

The liquid fabric care compositions of this invention comprise from about 25% to about 94% water, preferably from about 50% to about 80%.

OPTIONAL INGREDIENTS

Ingredients not inconsistent with the stability or performance of the fabric care compositions of the invention can be incorporated.

Ethyl alcohol and other water-soluble organic solvents can be utilized at levels up to about 10%, preferably from about 1% to about 5%, to aid in the incorporation of the surface-active agents. Hydrotropes or blending agents such as urea, and sodium, potassium, ammonium, mono-, di- or tri-ethanolammonium cumene sulfonate, benzene sulfonate, toluene sulfonate and xylene sulfonate and mixtures therefore can also find use to inhibit phase separation of the composition throughout a broad range of possible storage temperatures. Hydrotropes or blending agents can be used at levels up to about 8%, preferably from about 1% to about 6%.

Fabric softening and antistatic agents are particularly useful optional ingredients in the compositions of this invention as described in the copending application of Samuel M. Johnson and Emelyn L. Hiland, Ser. No. 885,937, filed concurrently herewith and incorporated herein by reference. Examples of fabric softening agents are cationic quaternary ammonium compounds such as ditallowdimethylammonium chloride or the smectite clays such as described in U.S. Pat. No. 3,936,537, incorporated herein by reference. Cationic quaternary ammonium compounds can be used at levels up to about 8%, preferably from about 0.25% to 4%. Smectite clays can be used as disclosed in the copending application of John W. Leikhim and Sharon J. Mitchell, Ser. No. 885,933, filed concurrently herewith, and incorporated herein by reference. Smectite clay fabric softening agents can be used in the compositions of this invention at levels up to about 15%, preferably from about 0.5% to about 8%.

In the process aspect of this invention, the alkaline pH can be provided by addition of sodium hydroxide or other alkaline material to a starch dispersion or to a mixture of the starch and other essential or optional components of the fabric care composition. Any excess alkali is then neutralized with a mineral acid or other acidic material to a pH range of from about 4 to about 9. The time required at the higher pH to provide stabilization will vary depending upon concentration, temperature, and agitation with a time in the range of about one to about five minutes being convenient. The final composition with its essential and any optional components can have a pH in the range of from about 4 to 11, preferably from about 5 to about 10.

In the method of use aspect of the present invention the fabric care composition is added to an aqueous laundry washing or rinse medium to provide from about 50 ppm to about 500 ppm, preferably from about 150 ppm to about 350 ppm, most preferably from about 200 ppm to about 300 ppm, of starch on a solids basis. From about 200 ppm to about 4000 ppm of surface-active detergent, preferably from about 300 to about 2000, most preferably from about 500 to about 1500, is desirable in the aqueous laundry medium when the composition is to be used in the practice of U.S. patent application Ser. No. 839,221, referred to hereinbefore. For use alone, or as a rinse additive, lower concentrations of surface active detergent, e.g., from about 100 ppm to about 1000 ppm, preferably from about 200 ppm to about 500 ppm, are desirable in the aqueous laundry medium.

Other ingredients can be included in minor amounts including optical brighteners, perfumes, anti-redeposition agents, detergency builder, suds suppressors, soil release agents, dyes, opacifiers, pigments, anti-bacterial agents, suds boosters, corrosion inhibitors, etc.

In the following examples, components other than water are added after processing of the starch component. This is convenient for control of pH but not essential for producing compositions within the scope of the invention.

All percentages, parts, and ratios herein are by weight unless otherwise specified.

EXAMPLE I

| | |
|---|---|
| 3.8% | Native Corn Starch. (Corn Products Corporation-3401). The starch is slurried under high shear, the temperature raised to 170° F. and held for 10 minutes; heat is removed and the slurry exposed to 0.05% NaOH for 2 minutes; after which the slurry is returned to pH 7.5 by addition of an appropriate amount of HCl. To this is added: |
| 18.5% | Sodium $C_{12}$ linear alkyl benzene sulfonate (NaLAS) |
| 0.07% | NaCl (resultant from processing step). |
| 5.0% | Sodium Carbonate |
| 3.5% | Ethanol |
| Balance | $H_2O$ |

The resultant composition was stable and did not gel or separate during storage.

The sodium $C_{12}$ alkyl benzene sulfonate is replaced respectively by the condensation product of $C_{14-15}$ alcohol and 7 moles of ethylene oxide, 3-(N,N-dimethyl-N-hexadecylammonio)-propane-1-sulfonate and sodium 3-(dodecylamino) propionate. Substantially similar stability characteristics are obtained.

To the above compositions 2% of a montmorillonite clay and 0.5% ditallowalkyl dimethyl ammonium chloride are added replacing an equivalent amount of water. Product stability is not adversely affected to any substantial degree.

EXAMPLE II

| | |
|---|---|
| 4.25% | Corn Starch - Acid Modified - Pregelatinized [Corn Products Company CPC-B511] AMIDEX B511 Prepared by slurrying under high sheer, exposing to 0.2% NaOH for two minutes, then returning to neutrality by addition of the proper amount of HCl. The following components are then added: |
| 0.29% | NaCl (reaction product) |
| 18.5% | Sodium $C_{12}$ linear alkyl benzene sulfonate [NaLAS] |
| 1.5% | Ethanol |
| Balance | $H_2O$ |
| pH = 7.1 | |

The resultant composition was stable and did not gel or separate during storage.

EXAMPLE III

| | |
|---|---|
| 4.25% | Quellin [Ester modified starch - Supplier KSH Chemicals Group] Prepared by slurrying starch, adding 1.0% NaOH raising temperature of slurry to 200° F. and maintaining for 20 minutes; at which time the slurry pH is returned to pH 7.5 by adding an appropriate amount of $H_2SO_4$ to neutralize any excess caustic. To this is added: |
| 1.5% | $Na_2SO_4$ (reaction product) |
| 12.5% | Mg $C_{12}$ linear alkyl benzene sulfonate [$Mg(LAS)_2$] |
| 2.0% | Ethanol |
| 2.5% | Potassium toluene sulfonate (KTS) |

-continued

| | |
|---|---|
| Balance | $H_2O$ |

The resultant composition was stable and did not gel or separate during storage.

EXAMPLE IV

| | |
|---|---|
| 6.0% | KOFILM 50 [ester modified starch - National Starch and Chemical] Prepared by slurrying, raising heat to 190° F. and agitating for 25 minutes. At this point 0.75% KOH is added. After 3 minutes exposure an appropriate amount of $H_3PO_4$ is added to bring about a pH of 7.0. To this is added: |
| 1.35% | $Na_3PO_4$ (reaction product) |
| 12.0% | Neodol 45-7 [$C_{14-15}$ average alcohol ethoxylated to an average of seven ethoxylate groups] |
| 4.0% | Sodium bicarbonate |
| 1.5% | Ethanol |
| Balance | Water |

The resultant composition was stable and did not gel or separate during storage.

EXAMPLE V

| | |
|---|---|
| 6.0% | Thin boiling native Corn Starch [Corn Products Company - 6448] Prepared by slurring, heating to 180° F. for 10 minutes at which time 10.25% of a silicate solution is added. |
| 10.75% | $Na_2O:SiO_2:H_2O$ 1.0% $Na_2O$ 3.0% $SiO_2$ 6.75% $H_2O$ |
| After cooling the following ingredients are added: | |
| 14.0% | NaLAS of Example I |
| 4.0% | Neodol 23-6.5 [$C_{12}$–$C_{13}$ linear alcohols ethoxylated to an average of 6.5 EO groups] |
| 3.0% | Sodium xylene sulfonate |
| 2.0% | Ethanol |
| Balance | Water |

The resultant composition was stable and did not gel or separate during storage.

EXAMPLE VI

| | |
|---|---|
| 3.5% | Staramic 747 - Pregelled corn starch [A. E. Staley] Simultaneously slurried and exposed to 0.5% NaOH for five minutes, at which point excess alkali is neutralized by adding the appropriate amount of $H_2SO_4$ resulting in |
| 0.75% | $Na_2SO_4$. To this is added: |
| 17.0% | Triethanolamine neutralized, linear alkyl ($C_{12}$) benzene sulfonate |
| 2.0% | Potassium carbonate |
| Balance | Water |

The resultant composition was stable and did not gel or separate during storage.

EXAMPLE VII

| | |
|---|---|
| 3.5% | Native Corn Starch [CPC 3005] Prepared by adding 3.0% $K_2CO_3$ to a slurry of starch and water. Heat is applied to raise temperature to 175° F. and maintained for 15 minutes. To this is added: |
| 18.5% | NaLAS of Example I |
| 3.0% | $K_2CO_3$ |
| 0.75% | Ditallow dimethyl ammonium chloride |
| 3.5% | Ethanol |
| Balance | Water |

The resultant composition was stable and did not gel or separate during storage.

What is claimed is:

1. A liquid fabric care composition suitable for restoring body to fabrics comprising:

(a) from about 1% to about 25% of a gelatinized and stabilized vegetable starch prepared by exposing a water dispersion of a gelatinized vegetable starch to a pH of from about 10 to about 13 to stabilize said starch and thereafter neutralizing any excess alkali to provide a pH of from about 4 to about 9;

(b) from about 5% to about 50% of a surface-active detergent selected from the group consisting of anionic, nonionic, zwitterionic and amphoteric surface-active detergents and mixtures thereof;

(c) up to about 20% of an electrolyte;

(d) from about 25% to about 94% water, said composition having a pH of from about 4 to about 11.

2. The composition of claim 1 wherein the starch is gelatinized by holding a water dispersion of said starch at a temperature above its gelatinization temperature for at least about 5 minutes and stabilized by exposing said dispersion to a pH of from about 10 to about 13 during the gelatinization procedure.

3. The composition of claim 1 wherein the vegetable starch is corn starch.

4. The composition of claim 2 wherein the surface-active detergent is anionic.

5. The composition of claim 4 wherein the anionic surface-active detergent is selected from the group consisting of alkali metal and alkaline earth metal salts of alkyl benzene sulfonate, alkyl sulfate, paraffin sulfonate, olefin sulfonate and alkyl ether sulfate, and mixtures thereof, wherein the alkyl and alkenyl groups contain from about 10 to about 20 carbon atoms and the ether group comprises from about 1 to about 30 moles of ethylene oxide per mole of alkyl sulfate.

6. The composition of claims 1, 2, 3, 4 or 5 comprising from about 2.5% to about 10% by weight of gelatinized and stabilized vegetable starch.

7. The composition of claims 1, 2, 3, 4 or 5 comprising from about 2.5% to about 10% by weight of gelatinized and stabilized starch and from about 10% to about 30% by weight of surface-active detergent.

8. The composition of claims 1, 2, 3, 4 or 5 wherein the water dispersion of gelatinized vegetable starch is stabilized by exposure to a pH of from about 10 to about 11 and said composition has a pH of from about 7 to about 10.

9. The composition of claim 1 which comprises from about 1% to about 10% of an electrolyte.

10. The composition of claim 9 which additionally comprises from about 1% to about 6% of a hydrotrope.

11. The composition of claim 10 which additionally comprises a fabric softening agent selected from the group consisting of cationic quaternary ammonium compounds, smectite clay and mixtures thereof.

* * * * *